United States Patent [19]

Lewin

[11] 3,988,609

[45] Oct. 26, 1976

[54] LIGHTING PANEL AND LUMINAIRE USING IT

[75] Inventor: Ian Lewin, Scottsdale, Ariz.

[73] Assignee: K-S-H, Inc., St. Louis, Mo.

[22] Filed: Mar. 14, 1975

[21] Appl. No.: 558,436

[52] U.S. Cl. ..... 240/106 R

[51] Int. Cl.[2] ..... F21C 5/02

[58] Field of Search ..... 240/106 R, 78 LD, 92

[56] References Cited

UNITED STATES PATENTS

| | | | |
|---|---|---|---|
| 2,258,354 | 10/1941 | Doane | 240/78 LD X |
| 2,318,716 | 5/1943 | Ralph | 240/51.11 |
| 2,368,014 | 1/1945 | Franck | 240/106.1 |
| 2,474,317 | 6/1949 | McPhail | 240/106 |
| 2,887,568 | 5/1959 | Franck | 240/106 R X |
| 3,340,393 | 9/1967 | Franck et al. | 240/106 R X |
| 3,483,366 | 12/1969 | Wince | 240/106 R |
| 3,721,818 | 3/1973 | Stahlhut | 240/106 |
| 3,829,680 | 8/1974 | Jones | 240/106 |

OTHER PUBLICATIONS

Holophane Co., Inc., Information Sheet 7100–A.

K-S-H, Inc., Information sheets KSH–12™ Lens.

*Primary Examiner*—Joseph F. Peters, Jr.

*Attorney, Agent, or Firm*—Polster and Polster

[57] ABSTRACT

Luminaires equipped with an improved high efficiency, wide light distribution lighting panel provide more favorable ESI values and may be spaced farther apart than conventional ones. The lighting panel includes three bands of conical prismatic elements; these bands are spaced on 5-inch centers from each other and are separated by substantially transparent bands having shallow 15° flutes to soften the lamp images. Outside the bands of conical prisms are bands of lengthwise elevating prisms for increasing the spread of light to the sides of the fixture. Outside the elevating bands are bands of lengthwise depressing prisms. A single panel design provides similar excellent optical characteristics for either a two-lamp or three-lamp troffer.

22 Claims, 8 Drawing Figures

LIGHTING PANEL AND LUMINAIRE USING IT

BACKGROUND OF THE INVENTON

This invention relates to a lighting panel for use in a lighting fixture having linear light sources. In particular, it relates to an improved lighting panel, for use in a two or three lamp fluorescent fixture, which permits wider spacing of such fixtures in a room while producing greatly improved lighting throughout the room regardless of the fixture spacing.

Considerations of conservation have recently underscored the desirability of improving existing lighting systems without adding lamps, of reducing the number of lamps utilized in existing systems, and of designing new systems with a minimum of lamps. It is also increasingly recognized that the quality of light for many tasks may not be seriously impaired, and indeed may be enhanced, by a reduction in the quantity of artificial light provided for the task. Limiting lighting systems to moderate footcandle levels (say 50 footcandles for general office use) or low energy consumption (say 2 watts or less per square foot) is now being proposed.

Lighting systems are needed which reduce direct glare and veiling reflection, which are highly efficient, and which may be widely spaced and still provide uniform lighting throughout a work area. It is also desirable that such lighting systems be adapted to improving existing systems, and that in new or updated installations they may be economical to install and maintain.

The comfort of a lighting system is largely dependent on the amount of direct glare experienced by a viewer in a particular position relative to the elements of the lighting system. A well-designed lighting system should have low luminances at high viewing angles and should have low maximum-to-average luminance ratios.

Although two different types of lighting systems may produce equal footcandles, the visibility created by one may be greater than the other. Equivalent sphere illumination (ESI) is the Illuminating Engineering Society method of expressing the effectiveness of footcandles. ESI is related to the contrast produced on the visual task. When the contrast is reduced because of veiling reflections, the effectiveness of footcandles is reduced also. Loss of contrast is produced when an excessive amount of light arriving on the task at a low angle (near the vertical) reflects into the viewer's eyes. A lighting system should ideally produce high ESI values for all viewing directions relative to the light sources.

The efficiency of a lighting system is, of course, vital to its success in conserving energy. The distribution of light from individual luminaires, however, is also important. Not only should the light distribution pattern increase the comfort and effectiveness of the luminaire, but it should also permit the luminaires of the system to be arranged in the most convenient and economical manner.

In many installations, the most convenient and economical arrangement of luminaires is in continuous parallel rows, spaced as far apart as necessary to produce the desired lighting levels. This arrangement permits the luminaires to be wired through the fixtures. However, it makes designing for decreased illumination levels very difficult. For example, a typical lighting system utilizing two foot by four foot troffers, each containing two 40 watt lamps, may arrange the fixtures in continuous rows spaced on eight foot centers to produce an average maintained illumination of about 100 footcandles. To reduce the average illumination to 50 footcandles, using the same arrangement, requires that the rows be spaced apart 16 feet on center. If the fixtures are mounted 10 feet above floor level, their mounting height is taken as 7.5 feet, the nominal working surface being taken as 30 inches. Therefore, 16 foot spacing yields a typical spacing-to-mounting height ratio of 2.1. Presently known troffers cannot produce an acceptably uniform illumination level at such high spacing-to-mounting height ratios. Although there are no formal standards, it is generally recognized that a ratio of maximum illumination to minimum illumination over about 1.3 is noticeable and objectionable.

Other arrangements of luminaires, such as broken rows, checkerboard patterns, and modular spacings, are also frequently used. It is therefore desirable that a lighting system also be sufficiently adaptable to provide improved lighting at various illumination levels utilizing any of a number of fixture arrangements other than continuous rows.

The various aspects of good lighting touched upon here are well known to those in the art and are discussed, for example, in the current edition of the Illuminating Engineering Society handbood and in more recent IES publications.

SUMMARY OF THE INVENTION

One of the objects of this invention is to provide a lighting system which produces high quality lighting when the fixtures of the system are arranged in any of a number of patterns and over a wide range of spacings.

Another object is to provide such a system which may utilize standard troffers, particular two- and three-lamp troffers, equipped with a novel flat lighting panel.

Another object is to provide such a system and panel which are extremely efficient.

A more specific object is to provide such a system and panel which produce uniform lighting at spacing-to-mounting height ratios of 2.1 or greater.

Another specific object is to provide such a system and panel which permit the use of continuous rows of troffers to produce uniform, effective, and comfortable lighting with very low energy consumption.

Another specific object is to provide such a system and panel which produce high ESI values when the fixtures of the system are arranged on normal spacings, for example, continuous rows on six or eight foot centers.

Other objects will become apparent in view of the following description and accompanying drawings.

In accordance with this invention, generally stated, a highly efficient lighting panel is provided for use in a troffer-type fixture, which produces along the lamps a depleted lighting pattern characteristic of a prismatic panel and which produces across the lamps a wide-spread lighting pattern having maximum intensity between about 30° and 50°, and a sharp cutoff above about 60°. (Throughout this description all angles, unless otherwise stated, are with respect to a line perpendicular to the plane of the panel, that is, in normal use, the vertical.)

The panel of the invention includes on the lower face of the panel a series of sets of bands running lengthwise of the lamps, each set of bands having a different function and geometry from the others. A set of prismatic cut-off bands lying directly below the lamps provide a prismatic control of light. The principles of prismatic lenses are well known and are set out, for example, in McPhail, U.S. Pat. No. 2,474,317. Preferably, these bands are made up of intersecting female conical prisms. Between the bands making up the first set of bands are bands which have no appreciable effect on the light passing through them, but which may be provided with shallow lengthwise flutes to break up the images of the lamps. The outermost bands are made up of depressing prisms running lengthwise of the bands. These prisms deflect downward those light rays which would otherwise escape in a direction across the lamps at high angles. Between the first set of bands and the outermost bands are bands of lengthwise elevating prisms, for increasing the intensity of light escaping the panel across the lamps at angles between about 30° and 50°.

It has been found that a flat panel with three prismatic cut-off bands separated by two relatively non-distorting bands provides similar outstanding light distributions and efficiencies with either a standard two-lamp or a standard three-lamp fixture. It has also been found that such fixtures arranged end-to-end in rows produce exceptionally good ESI values in all directions, despite the uneven candlepower distribution of the individual fixtures. The fixtures have higher efficiencies than those equipped with previously known commecial lighting panels, and they direct all of the increased lumen output into across lamp directions. Lighting systems having spacing-to-mounting height ratios of 2.1 or more are thereby made possible which maintain acceptable maximum to minimum illumination ratios of about 1.3 or less and which maintain adequate illumination levels even at very low energy consumption rates.

DESCRIPTION OF THE PREFERRED EMBODIMENT

Figure 1:
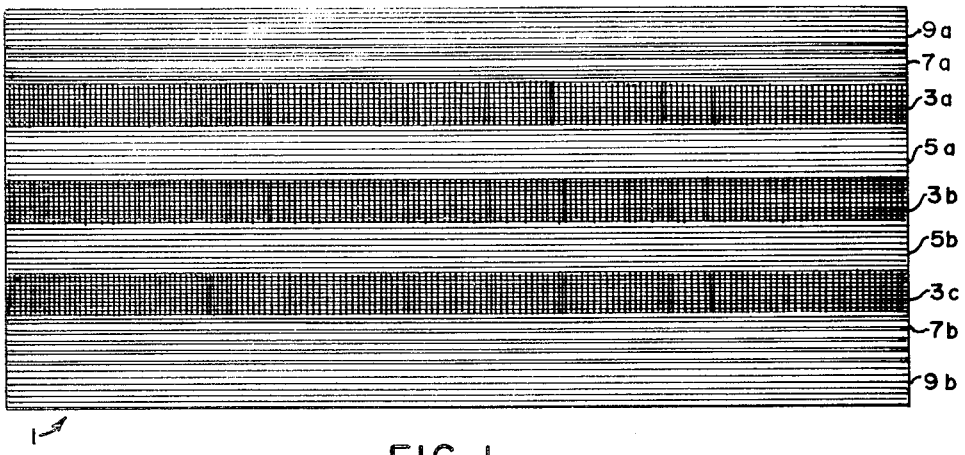
FIG. 1 is a bottom plan view of one embodiment of lighting panel of the present invention.
Figure 2:
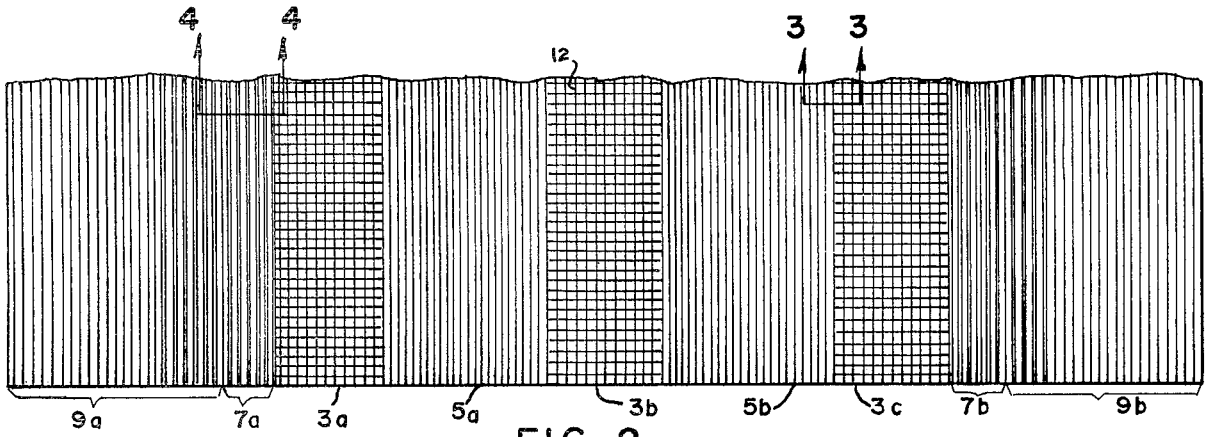
FIG. 2 is an enlarged fragmentary view of the panel of FIG. 1.
Figure 3:
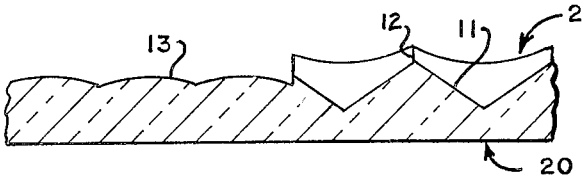
FIG. 3 is a sectional view taken along the line 3—3 of FIG. 2.
Figure 4:
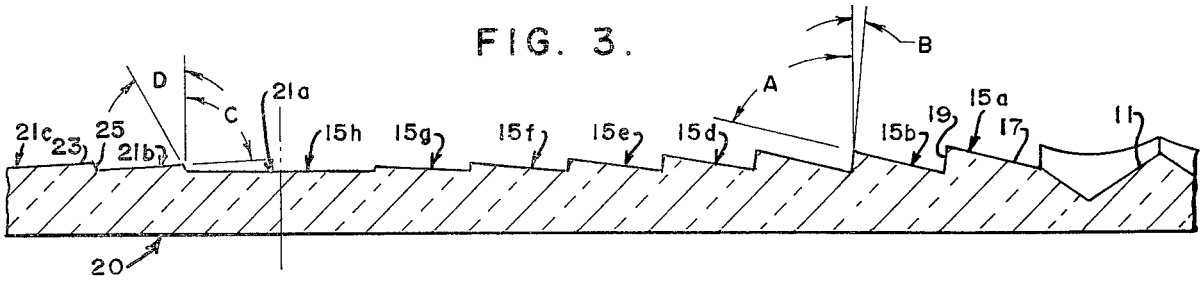
FIG. 4 is a sectional view taken along the line 4—4 of FIG. 2.

Referring now to the drawings, reference numeral 1 indicates a preferred embodiment of light-transmitting lens of this invention. The lens 1 is in the form of a flat lighting panel having a nominal width of two feet, and length of four feet. The panel is made of a transparent acrylic polymer. Other standard transparent materials, such as light-stabilized polystyrene or glass, are equally usable. The panel may have a maximum thickness of 0.125 inch, and a minimum effective thickness of 0.080 inch.

The panel 1 includes on its lower face 2 four sets of parallel bands running lengthwise of the panel. The first set consists of three identical bands 3*a*, 3*b*, and 3*c* of prismatic cut-off elements. The second set consists of two identical bands 5*a* and 5*b*, having shallow lengthwise flutes. The fluted bands 5*a* and 5*b* separate the cut-off bands 3*a*, 3*b*, and 3*c*. The third set of bands consists of two bands 7*a* and 7*b* of elevating prisms running lengthwise of the panels. The elevating bands 7*a* and 7*b* are positioned outboard of the two outer prismatic cut-off bands and are mirror images of each other. The fourth set of bands consists of two bands 9*a* and 9*b* of depressing prisms running lengthwise of the panel 1. The depressing bands 9*a* and 9*b* are positioned outboard of the elevating bands 7*a* and 7*b*, and are also mirror images of each other.

The cut-off bands 3*a*, 3*b*, and 3*c* are each two inches across and are made up of intersecting female conical prisms 11 having side walls which slope about 57° from the vertical and having apexes which are spaced apart three-sixteenths inch along lines parallel to the sides and ends of the panel 1. The intersections of the recessed cones therefore form a pattern of three-sixteenths inch square cells 12 with the sides of the cells parallel to the sides and ends of the panel 1. The apexes of the cones are recessed 0.080 inch above the corners of the cells 12, but the effective thickness of the panel is determined by the cell walls, as is well known in the art. A prismatic lighting panel having the same pattern of female conical prisms as the bands 3, but turned 45° to the panel edges, is sold by K-S-H, Inc., St. Louis, Mo., under the trademark KSH-12. The light distribution characteristics of a prismatic lighting panel are also well known in the art.

The fluted bands 5*a* and 5*b* of the second set of bands are each three inches wide. The lengthwise extending flutes 13 are 0.125 inch across, and each is a 15° flute, that is, each represents 15° of arc on either side of the vertical. The radius of curvature of each flute is, therefore, 0.241 inch. The flutes 13 are not rounded enough to cause any substantial deflection of light passing through them in any direction. They do, however, tend to break up the lamp images at those viewing angles where a lamp would otherwise be directly viewable through the bands 5*a* and 5*b*. The bands 5*a* and 5*b* have a transmission efficiency of more than 90%. Along the bands 5*a* and 5*b*, the panel 1 is about 0.083–0.085 inch thick.

Each elevating band 7*a* and 7*b* of the third set of bands is one inch across. Each includes eight elevating prisms 15, each 0.125 inch across, extending lengthwise of the band. The prisms 15 have a first, broad, relatively horizontal face 17 and a second, narrow, relatively vertical face 19, which form angles A and B, respectively, with the vertical. Labeling the prisms *a*, *b*, *c*, . . . outwardly from the inboard edge of the bands 7, the angles A and B have the values set out in the following Table 1 (all angles expressed in degrees):

Table 1

| Prism | A° | B° |
|---|---|---|
| 15a | 75.5 | 5 |
| b | 78 | 5 |
| c | 80 | 5 |
| d | 82 | 5 |
| e | 83.5 | 5 |
| f | 85 | 5 |

Table 1-continued

| Prism | A° | B° |
|---|---|---|
| g | 87 | 5 |
| h | 89 | |

The edges along which the prisms 15 meet are all 0.080 inch from the flat upper face 20 of the panel 1.

Each depressing band 9*a* and 9*b* of the fourth set of bands is four to five inches across, the width of the bands being dependent upon the actual width of the panel. Each band includes from 32 to 40 elevating prisms 21, each 0.125 inch across, extending lengthwise of the band. The prisms 21 are generally, but not exactly, mirror images of the prisms 15 of the adjacent elevating band. The prisms 21 also have a first, broad, relatively horizontal face 23 and a second, narrow, relatively vertical face 25, which form angles C and D, respectively, with the vertical. Again labeling the prisms 21 as *a*, *b*, *c*, . . . outwardly from the inboard edge of the bands 9, the angles C and D have the values set out in the following Table 2:

Table 2

| Prism | C° | D° |
|---|---|---|
| 21 a | 89 | |
| b | 87 | 30.5 |
| c | 87 | 31.5 |
| d | 84.5 | 31.5 |
| e | 84.5 | 32.5 |
| f | 81.5 | 32.5 |
| g | 81.5 | 33.5 |
| h | 79 | 33.5 |
| i | 79 | 34.5 |
| j | 77 | 34.5 |
| k | 77 | 35 |
| l | 75 | 35 |
| m | 75 | 35 |
| n | 75 | 35.5 |
| o | 72.5 | 35.5 |
| p | 72.5 | 35.5 |
| q | 72.5 | 36 |
| r | 70.5 | 36 |
| s | 70.5 | 36 |
| t | 70.5 | 37 |
| u | 68.5 | 37 |
| v | 68.5 | 37 |
| w | 68.5 | 37.5 |
| x | 66.5 | 37.5 |
| y | 66.5 | 37.5 |
| z | 66.5 | 37.5 |
| aa | 66.5 | 37.5 |
| bb | 66.5 | 38.5 |
| cc | 65 | 38.5 |
| dd | 65 | 38.5 |
| ee | 65 | 38.5 |
| ff | 65 | 38.5 |

All of the prisms beyond the thirty-second have the same angle C and angle D values as the prisms 21*cc* through 21*ff*. The edges along which the prisms 21 meet are also all 0.080 inch from the flat upper face 20 of the panel 1.

Figure 5:
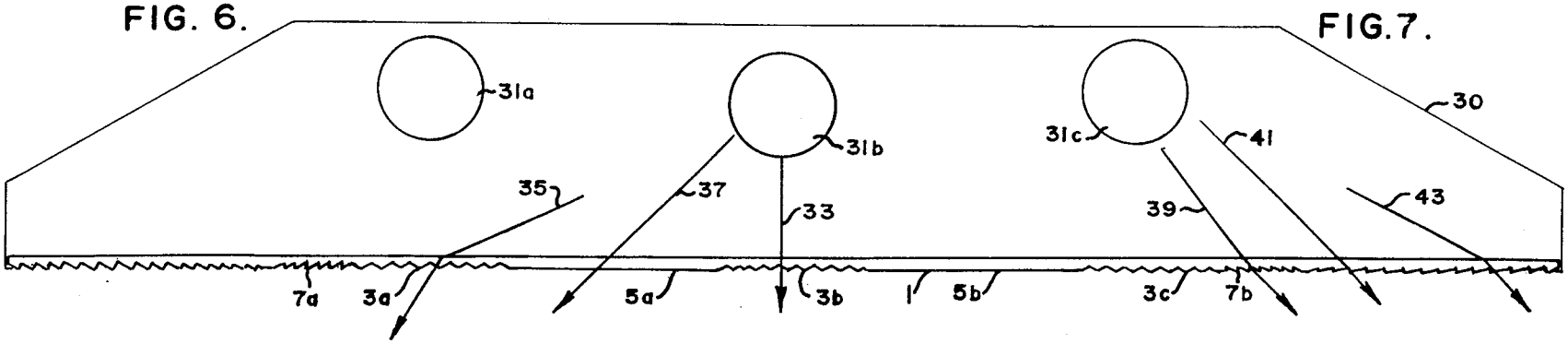
FIG. 5 is a somewhat diagrammatic sectional view, taken along a line perpendicular to the lamp axes, of a luminaire equipped with the panel of FIGS. 1–4, showing the effect of the panel on across-axis light rays.

Referring now more particularly to FIG. 5, reference numeral 30 indicates a standard commercially available recessed troffer in which is mounted the panel 1. A white enamel finish on the inside of the troffer 30 has a reflectance of 0.86. The troffer has provision for three 40 watt linear fluorescent tubes 31*a*, 31*b*, and 31*c* spaced apart on five inch centers. The troffer 30 is conventionally designed to permit the omission of the central fluorescent tube 31*b*, if desired. The centers of the outer lamps 31*a* and 31*c* are spaced 2.5 inches above the panel 1, and the center of the central tube 31*b* is spaced 2.25 inches above the panel 1.

It will be seen from FIG. 5 that the cut-off bands 3*a*, 3*b*, and 3*c* are positioned directly below the lamps 31*a*, 31*b*, and 31*c*, respectively. The light controlling function of the prismatic cut-off bands 3*a*, 3*b*, and 3*c* is shown diagrammatically in FIG. 5 by rays 33 and 35. It may be noted that the bands 3 perform their cut-off function regardless of the angle of incidence of light rays striking the bands 3. In particular, each band 3 cuts off light from adjacent tubes 31 as well as from the tube 31 directly above it. As is well known in the art, rays which would be emitted in the direct glare zone are reflected by the prisms 11 into the troffer 30 and are reflected from the troffer 30, with some light loss, back toward the panel 1.

The fluted bands 5*a* and 5*b* permit light to pass through generally undisturbed, as indicated diagrammatically by ray 37. It will be seen that the positions of the bands 5*a* and 5*b* relative to the lamps are such that light coming directly from either of the two lamps adjacent one of the bands 5 is traveling in a preferred direction to produce a wide-spread light distribution across the lamps without causing direct glare at high viewing angles.

The bands 7*a* and 7*b* of elevating prisms raise the angle at which most light rays striking the panel are emitted below the panel, relative to their angle of incidence, in across-tube planes. Ray 39 illustrates this effect. Most light through the elevating bands 7 comes directly from the adjacent fluorescent tube 31 and is directed from the panel at an angle of about 40°, an ideal angle for comfortable, effective lighting. The prisms 15 act as cut-off prisms for most light rays coming from tubes other than the tube 31 adjacent the band 7, although a small amount of light is emitted at angles of about 50°–60° near the junction of adjacent bands 7 and 9. Light rays from the opposite side of the vertical from the ray 39 do not contribute greatly to down lighting because of the relatively small amount of light striking the panel along the bands from outboard of the bands, and because of the relatively narrow dimensions of the bands.

The bands 9*a* and 9*b* of depressing prisms lower the angle at which most rays striking the panel are emitted below the panel in across-tube planes. The amount by which the rays are bent downward increases toward the outer edges of the bands. Rays 41 and 43 illustrate this effect. The light directly from the adjacent outboard lamp 31 again predominates over other sources and this light is directed into a useful zone, rather than becoming direct glare. Light from the other lamps is also directed downwardly, so as to reduce direct glare. Any tendency of the bands 9 to elevate light rays coming from a direction opposite the vertical from rays 41 and 43 (i.e. from a direction outboard of the spot where they hit the bands 9) is so minor as to be desirable for the more evenly lighted appearance it gives the panel from across-lamp viewing directions.

Figure 7:
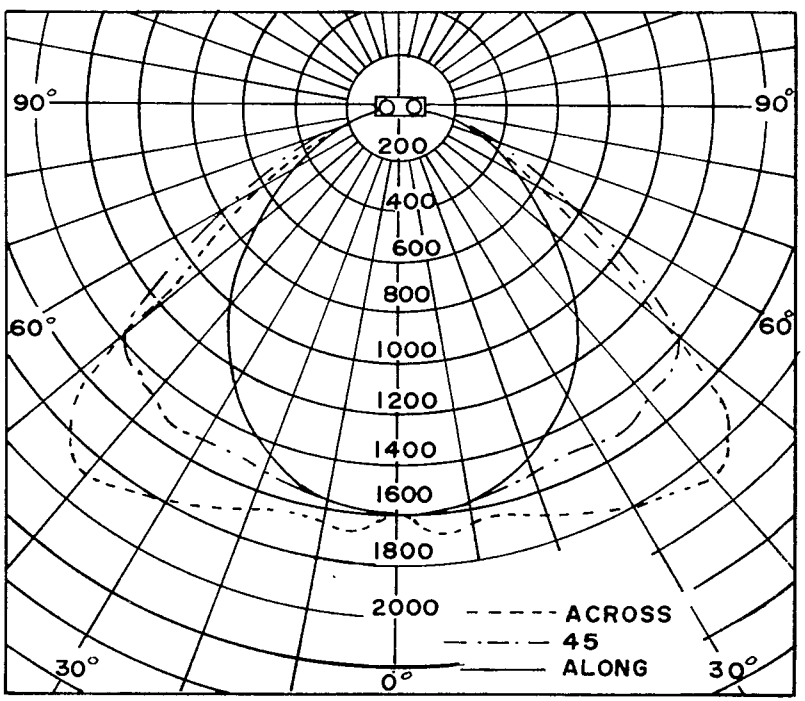
FIG. 7 is a candlepower distribution curve for a two-lamp luminaire.
Figure 6:
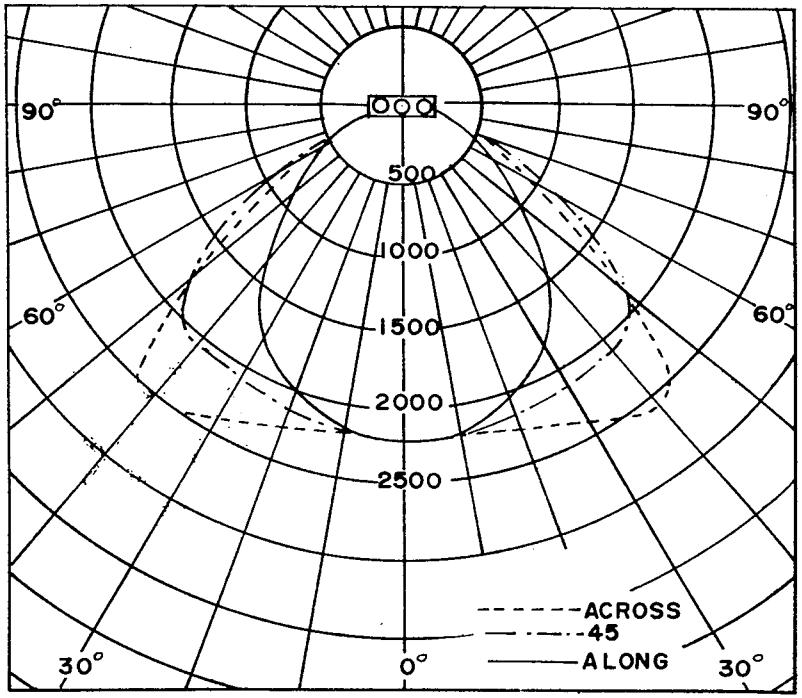
FIG. 6 is a candlepower distribution curve for a three-lamp luminaire such as that of FIG. 5.

FIGS. 6 and 7 show the candlepower distribution curves for the troffer 30 equipped, respectively, with three lamps and with two lamps. The lamps 31 each have an output of 3150 lumens. The following Table 3 and Table 4 give the measured candlepower values on which FIGS. 6 and 7 are based:

Table 3

| Angle | Across | 67.5 | 45 | 22.5 | Along | Average |
|---|---|---|---|---|---|---|
| | Candlepower Data Three-Lamp Troffer Plane | | | | | |
| 0 | 2175 | 2175 | 2175 | 2175 | 2175 | 2175 |
| 5 | 2192 | 2191 | 2190 | 2185 | 2184 | 2188 |
| 10 | 2195 | 2187 | 2175 | 2162 | 2157 | 2175 |
| 15 | 2217 | 2195 | 2153 | 2117 | 2104 | 2156 |
| 20 | 2263 | 2222 | 2132 | 2053 | 2029 | 2138 |
| 25 | 2317 | 2257 | 2093 | 1955 | 1909 | 2105 |
| 30 | 2375 | 2303 | 2101 | 1868 | 1790 | 2089 |
| 35 | 2511 | 2396 | 2112 | 1784 | 1648 | 2093 |
| 40 | 2554 | 2425 | 2088 | 1659 | 1433 | 2041 |
| 45 | 2351 | 2332 | 2042 | 1612 | 1223 | 1943 |
| 50 | 1829 | 1871 | 1890 | 1393 | 989 | 1641 |
| 55 | 1254 | 1316 | 1515 | 1218 | 793 | 1268 |
| 60 | 899 | 913 | 1091 | 1068 | 660 | 963 |
| 65 | 652 | 660 | 727 | 756 | 542 | 685 |
| 70 | 408 | 421 | 422 | 446 | 382 | 421 |
| 75 | 316 | 328 | 300 | 336 | 285 | 316 |
| 80 | 185 | 193 | 179 | 188 | 144 | 181 |
| 85 | 92 | 89 | 87 | 80 | 60 | 83 |

Table 4

| Angle | Across | 67.5 | 45 | 22.5 | Along | Average |
|---|---|---|---|---|---|---|
| | Candlepower Data Two-Lamp Troffer Plane | | | | | |
| 0 | 1587 | 1587 | 1587 | 1587 | 1587 | 1587 |
| 5 | 1667 | 1589 | 1591 | 1592 | 1592 | 1600 |
| 10 | 1647 | 1569 | 1570 | 1572 | 1574 | 1580 |
| 15 | 1650 | 1561 | 1537 | 1531 | 1534 | 1555 |
| 20 | 1691 | 1581 | 1514 | 1475 | 1476 | 1538 |
| 25 | 1760 | 1627 | 1496 | 1400 | 1393 | 1525 |
| 30 | 1796 | 1668 | 1511 | 1331 | 1306 | 1515 |
| 35 | 1843 | 1693 | 1521 | 1266 | 1201 | 1500 |
| 40 | 1889 | 1706 | 1472 | 1178 | 1050 | 1456 |
| 45 | 1783 | 1687 | 1454 | 1118 | 903 | 1401 |
| 50 | 1242 | 1289 | 1379 | 964 | 733 | 1155 |
| 55 | 818 | 828 | 1034 | 837 | 587 | 851 |
| 60 | 608 | 584 | 714 | 767 | 489 | 653 |
| 65 | 451 | 434 | 477 | 526 | 402 | 466 |
| 70 | 311 | 307 | 297 | 320 | 289 | 306 |
| 75 | 230 | 230 | 208 | 227 | 202 | 220 |
| 80 | 135 | 133 | 126 | 129 | 101 | 127 |
| 85 | 66 | 61 | 61 | 55 | 41 | 58 |

The candlepower data indicate that the panel 1 of this invention in a conventional 2 × 4 foot troffer produces candlepowers at low viewing angles which are fifteen to twenty percent less than those produced by a high quality prismatic panel, such as the KSH-12 panel mentioned previously. The reason for the reduced candlepower at small angles is that light is being directed in more usable directions. It will also be seen that, largely because of the prismatic bands 3, the troffer 30 produces in the along-axis direction a candlepower distribution curve which is characteristic of a prismatic panel. Across-axis, however, the panel produces a widespread distribution having a sharp drop-off above about 50°, a maximum intensity between 30° and 50°, and a gradual reduction in candlepower toward the vertical. The intermediate planes show distributions which are generally intermediate those of the across-axis and along-axis planes.

The total output, stated in lumens, of the three-lamp fixture of FIG. 6 and Table 3 is summarized in Table 5, and the same data for the two-lamp fixture of FIG. 7 and Table 4 is summarized in Table 6. In Tables 5 and 6, the zonal lumens for each 10° zone were calculated by multiplying by the zonal constant a weighted average of candlepower in the zone (computed by dividing by four the sum of the average candlepower at each limiting vertical angle plus twice the average candlepower at the intermediate vertical angle). The "Across ± 45°" values were calculated in the say way, using as the average candlepower for each vertical angle a value computed by dividing by eight the sum of the across-axis candlepower plus twice the 67.5° candlepower, plus the 45° candlepower for that vertical angle. The "Along ± 45°" values were similarly calculated, using as the average candlepower one-eighth of the sum of the along-axis candlepower plus twice the 22.5° candlepower plus the 45° candlepower.

Table 5

| Zone | Across ± 45° | Along ± 45° | Total | |
|---|---|---|---|---|
| | (Three lamps) (a) Lumens | | | |
| 0–10° | 104 | 103 | 208 | |
| 10–20° | 310 | 300 | 611 | |
| 20–30° | 518 | 459 | 976 | |
| 30–40° | 734 | 571 | 1306 | |
| 40–50° | 848 | 616 | 1465 | |
| 50–60° | 619 | 534 | 1153 | |
| 60–70° | 338 | 346 | 683 | |
| 70–80° | 164 | 162 | 326 | |
| 80–90° | 50 | 44 | 95 | |
| | (b) Total Output | | | |
| Zone | Across ± 45° | Along ± 45° | Total | |
| | lumens | lumens | lumens | percent |
| 0–40° | 1667 | 1434 | 3101 | 32.8 |
| 0–60° | 3135 | 2584 | 5719 | 60.5 |
| 0–70° | 3473 | 2930 | 6403 | 67.8 |
| 0–90° | 3687 | 3137 | 6824 | 72.2 |
| 30–50° | 1582 | 1187 | 2769 | 29.3 |
| 60–90° | 552 | 553 | 1105 | 11.7 |
| 70–90° | 214 | 207 | 421 | 4.5 |
| 90–180° | 0 | 0 | 0 | 0 |
| 0–180° | 3687 | 3137 | 6824 | 72.2 |

Table 6

| Zone | Across ± 45° | Along ± 45° | Total | |
|---|---|---|---|---|
| | (Two lamps) (a) Lumens | | | |
| 0–10° | 76 | 76 | 152 | |
| 10–20° | 224 | 217 | 441 | |
| 20–30° | 377 | 330 | 706 | |
| 30–40° | 528 | 410 | 938 | |
| 40–50° | 610 | 438 | 1048 | |
| 50–60° | 412 | 375 | 787 | |
| 60–70° | 227 | 242 | 469 | |
| 70–80 ° | 117 | 114 | 231 | |
| 80–90° | 35 | 31 | 66 | |
| | (b) Total Output | | | |
| Zone | Across ± 45° | Along ± 45° | Total | |
| | lumens | lumens | lumens | percent |
| 0–40° | 1204 | 1033 | 2237 | 35.5 |
| 0–60° | 2226 | 1846 | 4072 | 64.6 |
| 0–70° | 2453 | 2088 | 4541 | 72.1 |
| 0–90° | 2605 | 2233 | 4838 | 76.8 |
| 30–50° | 1138 | 848 | 1986 | 31.5 |
| 60–90° | 379 | 387 | 766 | 12.2 |
| 70–90° | 152 | 145 | 297 | 4.7 |
| 90–180° | 0 | 0 | 0 | 0 |
| 0–180° | 2605 | 2233 | 4838 | 76.8 |

It will be seen that the efficiencies of the troffer 30 and panel 1 are extremely high for either a three-lamp troffer or a two-lamp troffer. It will also be seen that most of the light flux from the troffer is contributing to the most effective kind of lighting.

Figure 8:
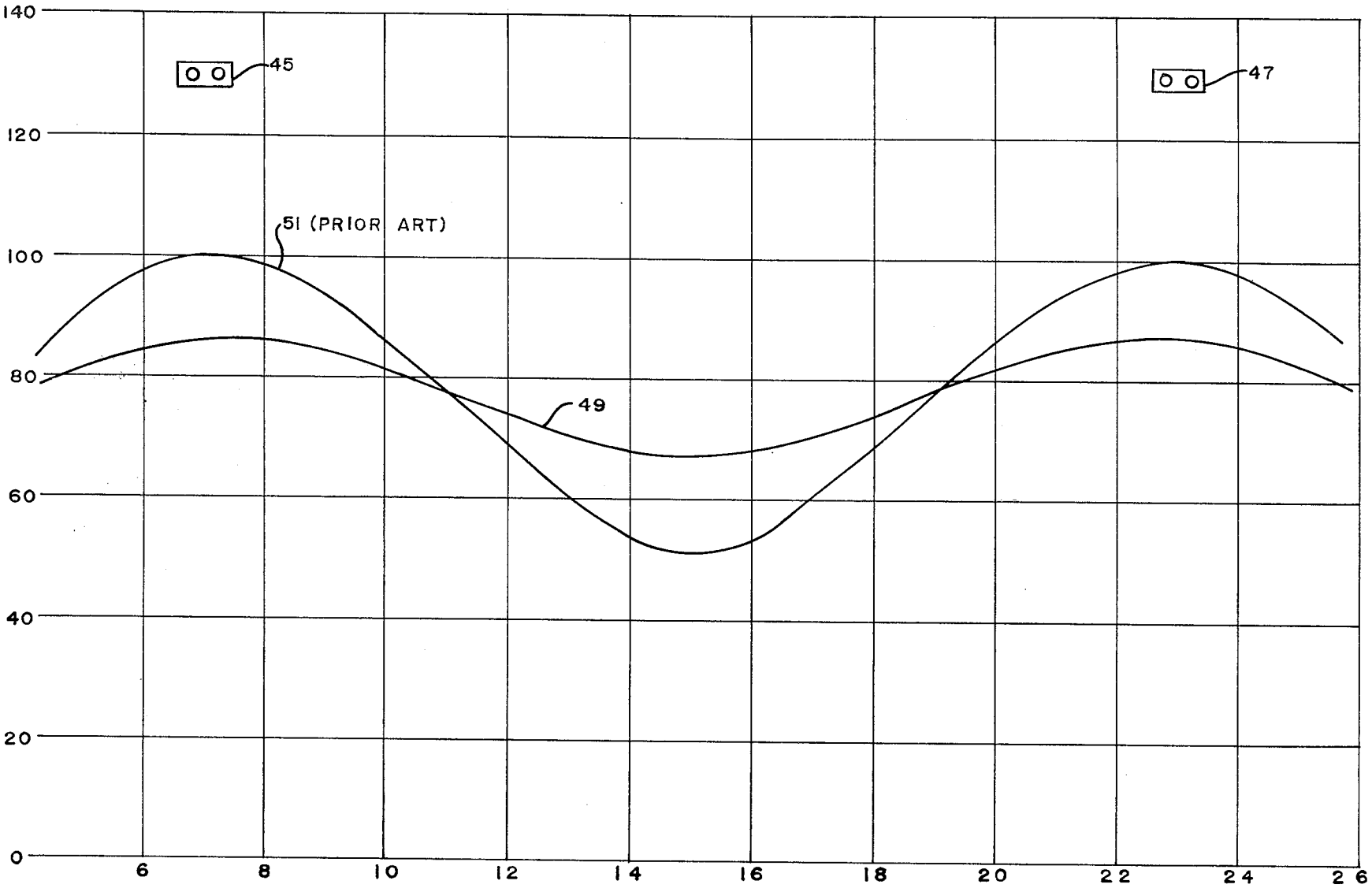
FIG. 8 is a graphical representation of illumination level in footcandles plotted against position in feet between two rows of luminaires spaced 16 feet on centers.

Because of the extremely high efficiency of a standard troffer equipped with the lens panel 1, and because of its unique light distribution characteristics, such troffers 30 can be arranged in lighting systems which are simple and efficient to install and operate, and which provide uniform and effective lighting over a wide range of lighting levels. For example, as illustrated by curve 49 in FIG. 8, a 30 foot by 30 foot room having a 10 foot floor-to-ceiling (troffer) height can be illuminated evenly by two rows 45 and 47 of two-lamp troffers of the present invention. FIG. 8 shows the variation in average illumination level, expressed in footcandles, along a line perpendicular to the rows 45 and 47 and spaced 7.5 feet from the rear wall of the room. Footcandle values were measured at 23 points along the line.

Each row 45 and 47 includes seven troffers 30 placed end-to-end. The spacing-to-mounting height ratio is in excess of 2.1, and the energy consumed is 1.56 watts per square foot. As shown in FIG. 8, the footcandle distribution curve 49 for the rows of luminaires equipped with the light panel of the present invention shows a maximum initial footcandle level of about 86 footcandles and a minimum of about 67 footcandles. This represents a maximum to minimum footcandle ratio of under 1.3. This lighting system produces a maintained average footcandle level of 60, if a 0.75 maintenance factor is assumed. The curve 51 in FIG. 8 shows the corresponding footcandle values when the rows 45 and 47 are made up of troffers having standard high quality prismatic lighting panels. Initial footcandle levels vary from a maximum of 100 to a minimum of 51, for a maximum to minimum footcandle ratio of nearly two. This ratio is unacceptable in most applications.

Troffers equipped with the panel 1 of the present invention may also be placed in other arrangements to produce high quality, uniform lighting at very low energy consumption rates. For example, a ceiling system composed of 10 foot square modules having a two-lamp fixture 30 in the center of each module, produces an acceptably uniform average lighting level of 30 to 35 footcandles. Other lighting systems utilizing other arrangements of luminaires may also be utilized. For example, broken (interrupted) rows of fixtures may be utilized to reduce lighting levels without loss of uniform lighting.

Not only do systems utilizing the fixtures 30 permit wide spacing of the fixtures and very low energy consumptions without sacrificing uniformity of lighting, they also produce highly effective (high ESI) lighting at all spacings and lighting levels. Thus, for example, in a 10 foot by ten foot modular ceiling, the two-lamp troffers 30 produce a 9% improvement in average ESI over a standard prismatic panel, and a 28% improvement in minimum ESI. In an eight foot by eight foot modular system, the two-lamp fixtures 30 produce an average ESI of 46.8, and a minimum ESI of 18.5, as compared with an average ESI of 42.2 and a minimum of 11.8, with a prismatic panel.

When the panel 1 is utilized in troffers having more usual spacings, outstanding ESI values are obtained. For example, with continuous rows of two-lamp fixtures 1 spaced six feet on center, a series of 276 ESI readings were calculated in accordance with Illuminating Engineering Society RQQ Report No. 5. ESI values were calculated looking in each of four directions at 23 points along each of three lines perpendicular to the rows. The ESI calculations show a minimum center-line ESI of 59, and an average overall ESI of 97. This corresponds to a maintained average ESI of about 73 if a 0.75 maintenance factor is assumed. These figures are more than ten percent higher than are produced by the same lighting system utilizing standard prismatic lighting panels. Continuous rows of two-lamp fixtures 1 on 8 foot centers produce a minimum initial center-line ESI of 43, and an average overall ESI of 81.

Numerous variations in the light transmitting lens and the fixture utilizing it will occur to those skilled in the art in light of the foregoing disclosure. For example, the dimensions of the bands may be varied somewhat to achieve particular lighting effects or to accomodate the peculiar lighting characteristics of a particular lighting fixture. If the spacing between the lamps of a two-lamp fixture should be small enough, or if a single lamp troffer is used, some of the central bands might need to be consolidated, although it is believed that to do so would sacrifice many of the advantages of the present invention. It is therefore to be understood that the term "set of bands" may include a set consisting of a single band unless otherwise indicated. The designs of the prismatic cut-off bands 3 and the separating bands 5 in particular may be altered to provide different sizes or orientations of prisms or to use other means for breaking up lamp images without significantly bending light rays. It has also been found that the distances between the panel and the fluorescent tubes may be altered within limits to produce lighting patterns which may be more desirable for certain purposes. For example, if the outer tubes 3*a* and 3*c* are spaced 3.125 inches above the panel (in either a two-lamp or three-lamp version), the fixture is very slightly less efficient and produces a lighting pattern which is spread across-axis somewhat less than the embodiment described, but which concentrates more light in the across-axis and intermediate planes between about 20° and 40° from the vertical. High angle cut-off is also more complete with the greater lamp-to-panel spacing. Although the figures given for the fixture 30 are for two- and three-lamp versions, still lower lighting levels and similar light distribution patterns may be obtained by using only one lamp in the fixture 30. Numerous other variations, within the scope of the appended claims, will also occur to those skilled in the art.

Having thus described the invention, what is claimed and desired to be secured by Lettes Patent is:

1. A substantially flat light transmitting panel for use below at least two parallel linear light sources, said panel having a generally smooth upper surface and a lower surface having a plurality of parallel light controlling bands, said bands comprising:

a. a first set of bands, at least two of said first set of bands being adapted to lie substantially below said linear light sources, each of said first set of bands comprising means for reducing high angle glare both along and across said light sources;

b. a second set of bands, each band of said second set of bands separating one band of said first set of bands from another band of said first set of bands, each of said second set of bands permitting most light to pass through without substantial alteration in direction; and c. a third set of bands comprising first and second bands outboard of said first set of bands, each band of said third set of bands comprising means for reducing the angle at which light is emitted below said panel across the linear light sources.

2. The panel of claim 1 further including d. a fourth set of bands, each band of said fourth set of bands lying between one of said first set of bands and one of said third set of bands, each of said fourth set of bands comprising means for increasing the angle at which light is emitted below said panel across said linear light sources.

3. The panel of claim 2 wherein said means of said first set of bands for reducing high angle glare is a pattern of intersecting cut-off prisms.

4. The panel of claim 3 wherein said means of said third set of said bands for reducing the angle at which light is emitted below said panel is a pattern of elongate depressing prism elements extending lengthwise of said bands, depressing prism elements nearer the outboard edge of said panel being oriented at smaller angles to nadir than depressing prism elements closer to the center of said panel to cause greater bending of light rays toward the vertical below said panel.

5. The panel of claim 4 wherein said means of said fourth set of bands for increasing the angle at which light is emitted below said panel is a pattern of elongate elevating prisms extending lengthwise of said bands.

6. The panel of claim 5 wherein said second set of bands includes a plurality of shallow elongate flutes extending lengthwise of said bands.

7. The panel of claim 5 wherein said first set of band consists of three bands and said second set of bands consists of two bands.

8. The panel of claim 5 wherein said first set of bands comprise three parallel bands of intersecting conical prisms, said bands of prisms being about one to three inches in width and being spaced about 4.5 to 5.5 inches on center from each other.

9. A lighting fixture having at least one linear light source, and a generally flat rectangular light-transmitting panel in said fixture below said light source, said panel producing a luminous intensity distribution which is characteristic of a prismatic lens along said linear light source, and producing widespread luminous intensity distribution across said linear light source, said panel comprising, on the lower side of said panel, a. a first set of bands extending lengthwise of said panel and lying substantially below said linear light source, each of said first set of bands comprising means for reducing high angle glare along said light source; and b. a pair of elevating bands outboard of said first set of bands, each of said elevating bands comprising longitudinally extending means lengthwise of said panel of elevating the angle at which light rays are emitted below said fixture across the linear light source.

10. The fixture of claim 9 wherein said panel further comprises on its lower side, c. a pair of depressing bands outboard of said pair of elevating bands, each of said depressing bands comprising means for depressing the angle at which light rays are emitted below said fixture across the linear light source.

11. The fixture of claim 9 wherein said means of said first set of bands for reducing high angle glare is a pattern of intersecting cut-off prisms which reduce high angle glare both along and across said light source.

12. The fixture of claim 11 wherein the luminous intensity at 50° from vertical along said linear light sources is less than half the luminous intensity at 0°, and wherein the luminous intensity at 40° from vertical across the linear light sources is at least 10% greater than at 0°.

13. The fixture of claim 11 wherein the total luminous output below the fixture is at least 70% of the luminous output of the linear light sources.

14. The fixture of claim 13 wherein the fixture contains two linear light sources and the luminous output below the fixture is at least 75% of the luminous output of said light sources.

15. A lighting fixture having at least one linear light source, and a generally flat rectangular light-transmitting panel in said fixture below said light source, said panel producing a luminous intensity distribution which is characteristic of a prismatic lens along said linear light source, and producing a widespread luminous intensity distribution across said linear light source, said panel comprising, on the lower side of said panel, a. three longitudinally extending parallel bands of intersecting prisms, at least one of said bands lying substantially directly below said linear light source, b. a first pair of bands separating said three bands of intersecting prisms, said first pair of bands having no substantial effect on the direction of light rays across said linear light source, and c. a second pair of bands outboard of said three bands of intersecting prisms, said second pair of bands each comprising longitudinally extending means lengthwise of said panel for elevating the angle at which light rays are emitted below said fixture across said linear light source.

16. The fixture of claim 15 further including a third pair of bands outboard of said second pair of bands, said third pair of bands each comprising means for depressing the angle at which light rays are emitted below said fixture across said linear light source.

17. A lighting fixture having at least one linear light source, and a generally flat rectangular light-transmitting panel in said fixture below said light source, said panel producing a luminous intensity distribution which is characteristic of a prismatic lens along said linear light source, and producing widespread luminous intensity distribution across said linear light source, said panel comprising, on the lower side of said panel, a. a first set of bands adapted to lie substantially below said linear light source, each of said first set of bands comprising means for reducing high angle glare along said light source; and b. a pair of depressing bands outboard of said first set of bands, each of said depressing bands comprising means for depressing the angle at which light rays are emitted below said fixture across the linear light source.

18. The fixture of claim 17 wherein said means of said first set of bands for reducing high angle glare is a pattern of intersecting cut-off prisms which reduce high angle glare both along and across said light source.

19. A lighting fixture having at least two parallel linear light sources, and a generally flat rectangular light-transmitting panel in said fixture below said light sources, said panel having a generally smooth upper surface and a lower surface having a plurality of parallel light controlling bands said bands comprising:

a. a first set of bands, at least two of said first set of bands being adapted to lie substantially below said linear light sources, each of said first set of bands comprising means for reducing high angle glare both along and across said light sources;

b. a second set of bands, each band of said second set of bands separating one band of said first set of bands from another band of said first set of bands, each of said second set of bands permitting most light to pass through without substantial alteration in direction; and c. a third set of bands comprising first and second bands outboard of said first set of bands, each band of said third set of bands comprising means for reducing the angle at which light is emitted below said panel across the linear light sources.

20. A substantially flat light-transmitting panel for use below at least one linear light source, said panel having a generally smooth upper surface and a lower surface having a plurality of parallel light controlling bands, said bands comprising:

a. three parallel bands of intersecting prisms, at least one of said bands being adapted to lie substantially directly below said linear light source;

b. a first pair of bands separating said three bands of intersecting prisms, said first pair of bands having no substantial effect on the angle at which light is emitted below said panel across said linear light source; and c. a second pair of bands outboard of said three bands of intersecting prisms, said second pair of bands comprising longitudinally extending means lengthwise of said panel for increasing the angle at which light is emitted below said panel across said linear light source.

21. A substantially flat light-transmitting panel for use below at least one linear light source, said panel having a generally smooth upper surface and a lower surface having a plurality of parallel light controlling bands, said bands comprising:

a. a first set of bands adapted to lie substantially below said linear light source, each of said first set of bands comprising means for reducing high angle glare along said light source;

b. a pair of elevating bands outboard of said first set of bands, each of said elevating bands comprising means for increasing the angle at which light is emitted below said panel across said linear light source; and c. a pair of depressing bands outboard of said pair of elevating bands, each of said depressing bands comprising means for reducing the angle at which light is emitted below said panel across said linear light source.

22. The panel of claim 21 wherein said means of said first set of bands for reducing high angle glare is a pattern of intersecting cut-off prisms which reduce high angle glare both along and across said light source.

* * * * *